US006692119B2

(12) United States Patent
Yu et al.

(10) Patent No.: US 6,692,119 B2
(45) Date of Patent: Feb. 17, 2004

(54) METHOD OF REGULATING PRESSURE OF INK CARTRIDGE AND THE PRESSURE REGULATING DEVICE THEREOF

(75) Inventors: Rong-Ho Yu, Hsinchu (TW); Cheng-Min Chang, Hsinchu (TW)

(73) Assignee: Microjet Technology, Co., Ltd. (TW)

( * ) Notice: Subject to any disclaimer, the term of this patent is extended or adjusted under 35 U.S.C. 154(b) by 0 days.

(21) Appl. No.: 10/140,586

(22) Filed: May 7, 2002

(65) Prior Publication Data

US 2003/0038866 A1 Feb. 27, 2003

(30) Foreign Application Priority Data

Aug. 24, 2001 (CN) ..... 01120985 A

(51) Int. Cl.[7] ..... B41J 2/175
(52) U.S. Cl. ..... 347/86
(58) Field of Search ..... 347/85, 86, 87, 347/93; 430/126

(56) References Cited

U.S. PATENT DOCUMENTS 4,968,998 A * 11/1990 Allen ..... 347/85
5,657,065 A * 8/1997 Lin ..... 347/93
5,801,737 A * 9/1998 Sato et al. ..... 347/86
5,949,461 A * 9/1999 Jones et al. ..... 347/87
5,965,315 A * 10/1999 Fujii et al. ..... 430/126
6,431,698 B1 * 8/2002 Mou et al. ..... 347/86
6,523,946 B2 * 2/2003 Mou et al. ..... 347/86

* cited by examiner

*Primary Examiner*—Anh T. N. Vo
(74) *Attorney, Agent, or Firm*—Madson & Metcalf

(57) ABSTRACT

A mechanism for regulating pressure within the interior of ink cartridge is peculiarized by that a filter which is telescoped by a sleeve is taken as a pressure-regulating member. The sleeve is telescoped with one end of a conduit and is communicable with the external atmosphere of the ink cartridge. By using the filter comprising uniformly arranged fiber bundles, a capillary action is created on the filter so that the back pressure can be maintained and the air can be introduced into the ink cartridge through the conduit. The negative pressure of the ink cartridge can be maintained at a best equilibrium state and the ink cartridge can be kept at an optimum condition.

24 Claims, 4 Drawing Sheets

METHOD OF REGULATING PRESSURE OF INK CARTRIDGE AND THE PRESSURE REGULATING DEVICE THEREOF

FIELD OF THE INVENTION

The present invention is related to a method of regulating pressure of an ink cartridge and the pressure regulating device thereof. In further detail, the present invention is directed to a pressure regulating device which makes use of a porous filter installed within a receiving chamber as a pressure regulating device to regulate the back pressure within the ink cartridge and the pressure regulating method using same.

BACKGROUND OF THE INVENTION

Currently, the inkjet printer has become an indispensable printing peripheral device for a personal computer (or PC). With regard to the components of an inkjet printer, the ink cartridge is undoubtedly the most important expendable of the inkjet printer. With the intention of enabling the ink cartridge to reach an optimum condition and preventing the ink leakage in the middle of printing, the internal pressure-regulating mechanism must maintain a fine performance, such that the back pressure of the ink cartridge is able to be maintained at a stable level. Thereby a constant volume of ink can be supplied in operation. Otherwise, if the back pressure of the ink cartridge can not be maintained at a stable level, the ink is likely to leak from the print head or fails to be ejected out, and the longevity of the ink cartridge will be reduced accordingly.

U.S. Pat. No. 5,409,134 issued to Cowger et al. has addressed a superficial discussion to the back pressure issue, in which the "back pressure" mentioned herein indicates that a partial vacuum within the ink cartridge or the pressure that is slightly smaller than the external atmospheric pressure of the ink cartridge. The back pressure can permit the ink within the ink cartridge to be maintained at a stable state and inhibit the flow of the ink through the print head as the print head is inactive. Also, the back pressure can permit the ink to be ejected out smoothly as the print head is active. The bubble generator as disclosed in this example comprises an orifice extending from the recess in the bottom wall of the ink cartridge housing to communicate with the exterior, for introducing external air into the ink cartridge through the orifice to maintain the back pressure of the ink cartridge.

The pressure-regulating mechanisms for other ink cartridges are different with each other. An example of such a pressure-regulating mechanism is given in U.S. Pat. No. 4,931,811 issued to Cowger et al., also shown in FIG. 1 of the present invention. The pressure-regulating mechanism of FIG. 1 is basically formed by filling the ink cartridge with a porous material (foam sponge), which has a strong ink-absorbing capability to store ink, and matches up with the air vent 12 on the upside of the ink cartridge 11 to achieve the negative-pressure regulation function for the ink cartridge. Nonetheless, the pressure-regulating mechanism of FIG. 1 is disadvantageous because the porous material has a strong ink-absorbing capability, a certain amount of ink will be remained in the porous material when the ink within the cartridge is nearly used up, and it invisibly causes a waste of ink.

As depicted in FIG. 2, the negative pressure of the ink cartridge 21 is regulated by a negative-pressure regulating tube 20. The negative-pressure regulating tube 20 locally comprises air vents which uses capillary action to regulate the back pressure within the ink cartridge 21 and thus achieve the negative-pressure regulation function. Such pressure regulating mechanism also can be seen in U.S. Pat. No. 5,081,737 issued to Sato et al. The pressure regulating technique disclosed in this example is quite complicated, and the pressure regulating mechanism disclosed herein not only includes capillaries but also includes a greater number of components for allowing the air to permeate thin films.

FIGS. 3(*a*) and 3(*b*) show another embodiment of the pressure regulating mechanism using capillary action to regulate the pressure of the ink cartridge. The pressure regulating mechanism as shown in FIGS. 3(*a*) and 3(*b*) is also known by U.S. Pat. Nos. 5,600,358 and 5,526,030. The art of pressure regulating according to the pressure regulating mechanism of FIGS. 3(*a*) and 3(*b*) is to establish a conical opening 31 on the bottom of the ink cartridge 21. A number of ribs are provided on the opening 31 to hold the sphere 30, and crevices are created between the opening 31 and the sphere 30. The crevices then form capillary air vents. The sphere 30 is capable of containing the leaked ink by means of capillary action and keeping the moisture of the air vents.

As a part of prior art pertinent to the present invention, a co-pending U.S. patent application Ser. No. 09/433,235 filed on Nov. 4, 1999 by the Applicant describes an ink-jet cartridge, which includes a hollow tube including a first opening fixed on a cap of a housing and a second opening located at the bottom of the interior of the housing. This example is characteristic of the second opening having a smaller cross-section than the first opening. In this way, the pressure within the interior of the housing will be regulated by a capillary action of the ink contained in the second opening. However, this example fails to teach the way of using a receiving chamber installed with filtering material, such as porous material or fibrous material to regulate the pressure within the ink cartridge.

Another example relevant to the present invention may be seen from a co-pending U.S. patent application Ser. No. 09/867,196 filed on Jan. 9, 2001 by the Applicant, which is also incorporated herein for reference. This example describes a containing member connected to an opening of a hollow tube for containing therein an ink of the container, wherein the containing member is made of a material having a higher adherent wetting property than the hollow tube.

In conclusion, the pressure regulating techniques of FIG. 2 and FIG. 3 both utilize capillarity to regulate the negative pressure of the ink cartridge. When the internal pressure of the ink cartridge is dropped, air is supplemented to the ink cartridge through the capillaries to raise the pressure within the ink cartridge to a stable state. When the internal pressure of the ink cartridge is raised, the ink can flow out of the cartridge or into capillary orifices. However, when the internal pressure of the ink cartridge is dropped again, the pressure difference and the capillarity is able to inhale the ink back to the ink cartridge.

In view of the foregoing two types of pressure-regulating mechanism for the ink cartridge, though the manufacturing process of the first type pressure-regulating mechanism is simple, however, because the porous material occupies a large space, the ink content of the ink cartridge will be dropped. The second type pressure-regulating mechanism is quite complicated in structure, but it can fully utilize the space within the ink cartridge. Above all, both of the two types of pressure-regulating mechanism need high-precision process steps to match the curved members and conical columns with capillary orifices to form capillaries. In this way, the prior pressure-regulating mechanism will result in a complex assembling process, a low yield and a sumptuous cost.

In order to obviate the disadvantages of the prior press-regulating mechanism for ink cartridge, a pressure-regulating mechanism for ink cartridge with a simple structure and easy-to-manufacture characteristic is highly expected.

SUMMARY OF THE INVENTION

An object of the present invention is to provide a method of regulating pressure of an ink cartridge and the pressure regulating device thereof, in which a filter is telescoped by a sleeve and connected with one end of a conduit which has another end connected to the exterior of the ink cartridge. By way of the fiber being arranged with a uniform density, a capillary action is created on the filter to enable the filter to have the faculties to contain ink and supplement air through the conduit into the ink cartridge. The negative pressure within the ink cartridge then can be maintained at a best equilibrium state, and the ink cartridge is kept in a optimum ink supply status.

It is to be known from the above statements that the present invention is characterized by using a porous filter as the pressure-regulating component to simplify the sophisticated manufacturing process and the processing steps. The porous filter can be made up of bundles of fibrous material, and preferably the fibrous materials is made up of a polymer comprising polypropylene and polyethylene or the like, which has a density ranged from 0.01 g/cm$^3$ to 0.8 g/cm$^3$ and is selected based on the physical characteristic of ink absorption. If the filter is made up of fiber, it is axially arranged in order to prevent inadequate air supplement operation. More preferably, the filter comprises tens of bundles of fibrous material with a cross sectional diameter of 2.0 millimeter to 9.0 millimeter.

For the purpose of enabling the filter to connect with the conduit to create an overall capillary action, the filter is telescoped by a sleeve being telescoped with the conduit. Preferably, the sleeve is made up of an elastic material, such as rubber, silica gel and so forth. One embodiment of the sleeve comprises a hollow portion including a gradually-shrinking portion and a tubular portion. A perforation is established on the cross section of the gradually-shrinking portion for telescoping with the conduit. Another perforation is established on the cross section of the tubular portion for telescoping with the filter. The tubular portion is slightly longer than the filter so as to receive the entire filter. The filter is wrapped up by the sleeve so that the ink can flow into the filter unanimously. The two perforations of the sleeve is tightly cooperated with the members to be telescoped, such as conduit and filter, so that the conduit, sleeve and the filter are firmly jointed.

Now the foregoing and other features and advantages of the present invention will be more clearly understood through the following descriptions with reference to the accompanying drawings, in which:

DETAILED DESCRIPTION OF THE PREFERRED EMBODIMENT

Figure 1:
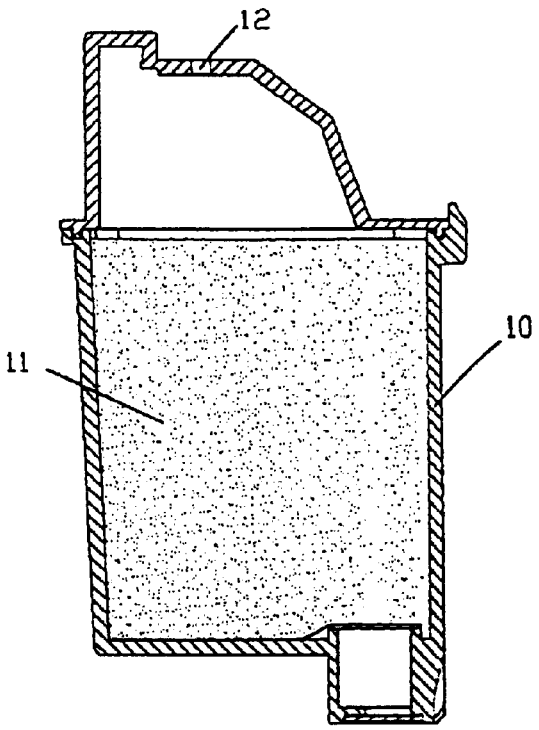
Fig. 1 Prior Art
FIG. 1 shows a prior pressure-regulating mechanism using porous material.
Figure 2:
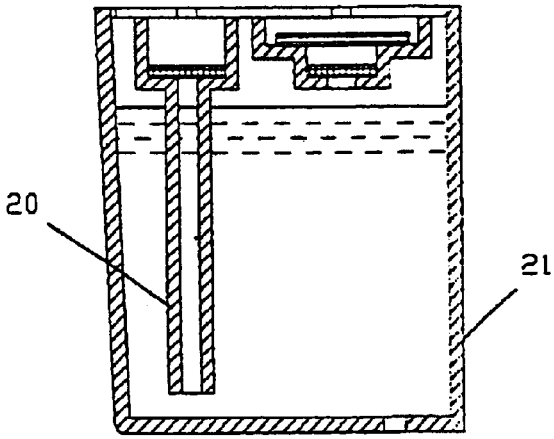
Fig. 2 Prior Art
FIG. 2 shows a prior pressure-regulating mechanism using capillary to regulate the negative pressure of the ink cartridge.
Figure 3A:
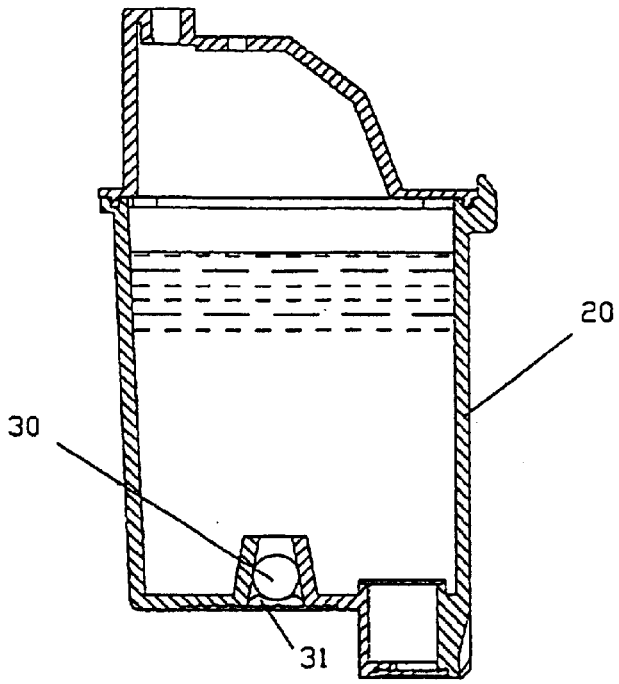
Fig. 3(a) Prior Art
FIGS. 3(*a*) and FIG. 3(*b*) show a prior pressure-regulating mechanism using conical opening and sphere to regulate the negative pressure of the ink cartridge.
Figure 3B:
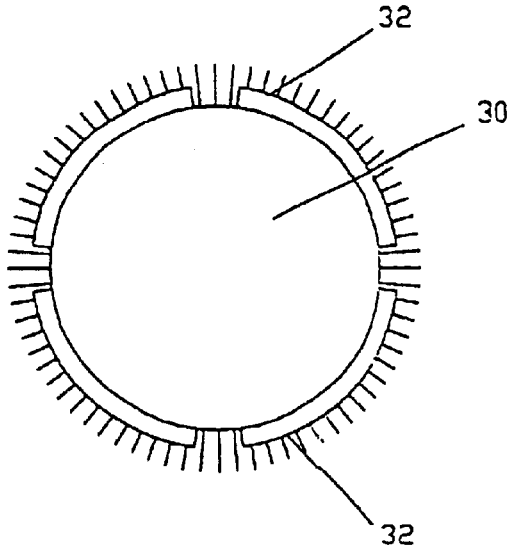
Fig. 3(b) Prior Art
Figure 4A:
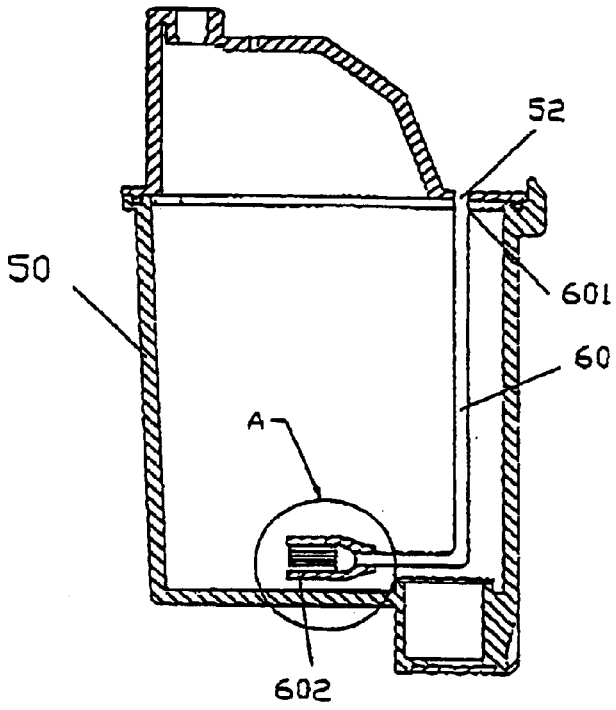
FIG. 4(*a*) depicts a preferred embodiment of the pressure-regulating mechanism of the present invention, and FIG. 4(*b*) depicts an amplified diagram of the portion "A" indicated by FIG. 4(*a*)
Figure 4B:
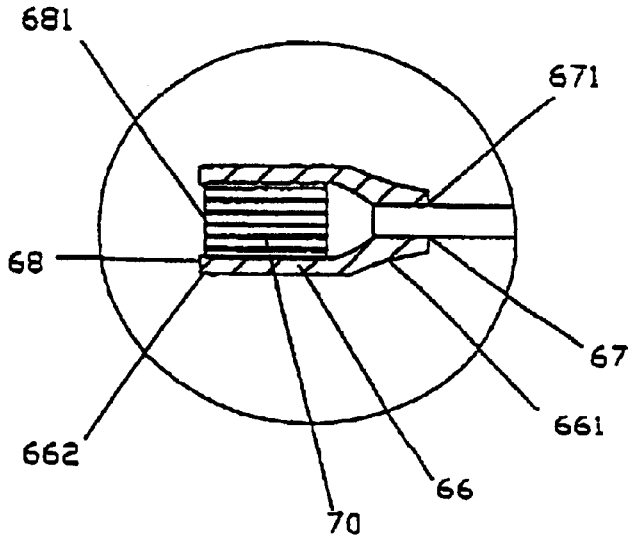

Referring now to FIG. 4, one embodiment of the pressure-regulating mechanism of the present invention comprises an ink cartridge 50 including a housing, a cap and ink outlets. The cap and the ink supplies are respectively integrated with the top and the opposite bottom of the housing. The cap is provided with an opening portion and communicable with the exterior of the ink cartridge 50. The ink cartridge 50 is provided with a pressure-regulating mechanism inside comprising a conduit 60, a sleeve 66 and a filter 70. The conduit 60 is a tubule comprising a first opening 601 and a second opening 602 with an inner diameter of 0.4 millimeter to 3.0 millimeter. The portion of the conduit 60 in the proximity of the second opening 602 is curvedly detoured around the bottom of the ink cartridge 50. The curved transverse tubular portion of the conduit 60 is allowable to contain the leaked ink, and a stable back pressure can be maintained even the ink is almost used up. The first opening 601 is connected to the upper opening 52 of the ink cartridge 50 to conduct the external air to flow into the conduit 60 and into the ink cartridge 50 through the filter 70, and the back pressure of the ink cartridge 50 is regulated by the incoming air. The lower opening of the conduit 60 is connected with a sleeve which is telescoped with a filter 70. In order to resist the corrosion of the ink, the conduit 60 can be made up of stainless steel or other plastic material that has an anticorrosive characteristic. The conduit 60 not only can connect with the filter and the external atmosphere, but can keep the moisture to prevent the rapid volatilization of the ink in the filter 70. Also, when the pressure is changed due to several environmental factors, the conduit 60 has the faculty of storing the leaked ink to alleviate the change of pressure.

The sleeve 66 is directed to a tubular object, and can be made up of an elastic material such as rubber, silica gel and so forth. One embodiment of the sleeve 66 comprises a hollow portion including a gradually-shrinking portion 661 and a tubular portion 662. A perforation 671 is established on the cross section 67 of the gradually-shrinking portion 661 so that the sleeve 66 is able to telescope with the conduit 60. Another perforation 681 is established on the cross section 68 of the tubular portion 662 so that the sleeve 66 is able to telescope with the filter 70. It is to be noted that the tubular portion 662 is slightly longer than the filter 40 so that the tubular portion can receive the entire filter 70. The two perforations (671, 681) of the sleeve 66 are tightly cooperated with the members to be telescoped, such that the conduit 60, sleeve 66 and the filter 70 are firmly jointed.

The conduit 60 and the sleeve 66 can be combinationally referred to as a hollow tubular member, and can be manufactured by an integrally manufacturing technique. The filter 70 comprises a porous structure made of a foam material or bundles of fibrous material.

Figure 5:
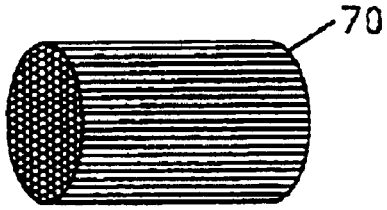
FIG. 5 is a cubical view showing the filter of the pressure-regulating mechanism according to a preferred embodiment of the present invention.

FIG. 5 illustrates that the filter 70 comprising the fibrous material are taken as the pressure-regulating mechanism for the ink cartridge 50. The fibrous material is made up of a polymer comprising polypropylene and polyethylene or the like, and has a density that is selected based on the physical characteristic of ink absorption of the material, typically in the range of 0.01 g/cm3 to 0.8 g/cm3. The filter 70 preferably comprises tens of bundles of fiber being axially arranged, so as to effectively control the flow direction of the ink. The filter 70 has a cross sectional diameter of 2.0 millimeter to 9.0 millimeter. Certainly the fibrous material can be substituted by a foam material of the same density.

When the ink cartridge 50 is active in printing, the ink within the ink cartridge 50 will be decreased in the operation of printing. The space within the ink cartridge, however, will be increased and the back pressure of the ink cartridge will be raised. While the external atmospheric pressure is greater than the sum of the pressure at the filter 70 and the pressure difference resulting from the surface tension on the filter 70, the air will be introduced into the ink cartridge 50 through the conduit 60 and the filter 70 to regulate the back pressure within a working range.

Besides, a prevalent condition that the ink leakage is most likely to happen is when the ink cartridge 50 is placed casually and then the ink outlet thereof is positioned higher than all portions, namely, the ink cartridge 50 is placed slantingly or upside down. Under this condition, if there has no filter within the ink cartridge, the air is introduced to enter the ink cartridge and thus the negative pressure of the ink cartridge will be destroyed. On the contrary, though the filter 70 of the present invention is not immersed in the ink under this condition, the ink content of the filter can be maintained due to the structural characteristic of the filter 70, and therefore the ink within the filter is not easy to dry off to prevent the air entering the ink cartridge from destroying negative pressure.

Figure 6:
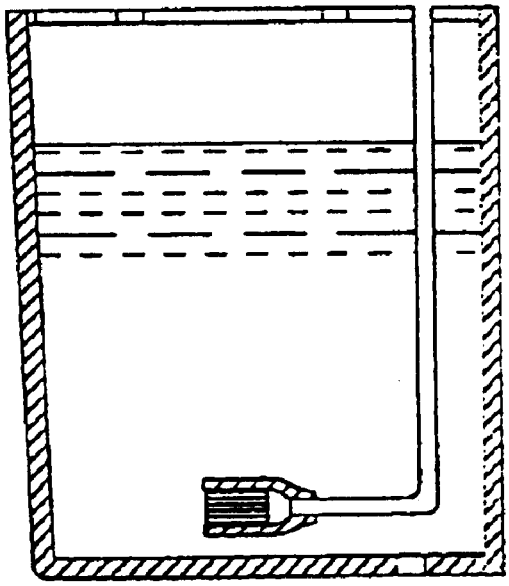
FIG. 6 depicts another preferred embodiment of the pressure-regulating mechanism of the present invention.

The foregoing pressure regulating device is feasible for a variety of ink cartridges, as shown in FIG. 6. It should be noted that the pressure regulating device of the present invention can be presented by various embodiments, for example, the conduit 60 and the sleeve 66 can be integrally manufactured to save the components. The pressure regulating device of the present invention utilizes simple mechanism to eliminate complicated process steps and precise cooperation on the component size, thereby improving the yield and reducing the manufacturing cost.

Although the present invention has been described and illustrated in detail, it is to be clearly understood that the same is by the way of illustration and example only and is not to be taken by way of limitation, the spirit and scope of the present invention being limited only by the terms of the appended claims.

We claim:

1. A method of regulating pressure of an ink cartridge comprising:

(1) providing an opening communicable with an external fluid on a housing of said ink cartridge;

(2) providing a hollow tubular member with two openings respectively located at two ends thereof, in which one end of said hollow tubular member is coupled with said opening on said housing and another end of said hollow tubular member comprises a receiving chamber with a constant length and a cross section being expandable to a certain degree; and (3) providing a porous structure capable of creating a capillary action and being received in said receiving chamber, said porous structure operatively allows said external fluid to enter said ink cartridge from said opening on said housing by flowing into said hollow tubular member through said porous structure when a difference between said pressure of said ink cartridge and a pressure of said external fluid is limited to a constant range, so as to regulate the internal pressure of said ink cartridge.

2. The method of claim 1 wherein one end of said hollow tubular member is curvedly detoured around a bottom of said ink cartridge.

3. The method of claim 1 wherein said hollow tubular member has an inner diameter of 0.4 millimeter to 3.0 millimeter.

4. The method of claim 1 wherein said hollow tubular member comprises one selected from a stainless steel or a plastic material.

5. The method of claim 1 wherein said porous structure comprises bundles of fibrous materials, and said fibrrous materials comprises a polymer comprising polypropylene and polyethylene.

6. The method according to claim 5 wherein said porous structure has a density ranged from 0.01 g/cm$^3$ to 0.8 g/cm$^3$ and a cross-sectional diameter of 2.0 millimeter to 9.0 millimeter.

7. The method of claim 1 wherein said receiving chamber comprises a hollow portion including a gradually-shrinking portion and a tubular portion, and two openings respectively located at two ends thereof, in which said gradually-shrinking portion is telescoped with said conduit and said tubular portion is allowable to receive said porous structure.

8. A pressure regulating device for an ink cartridge, wherein said ink cartridge comprises a housing, a cap and an ink outlet, said cap and said ink outlet are respectively mounted on a top portion and a bottom portion of said housing, said pressure regulating device comprising:

a conduit;

a sleeve; and a filter;

wherein said pressure regulating device is characterized by that said conduit is provided with a first opening connected with an opening portion of said cap and a second opening connected with said sleeve, said sleeve is allowable to receive said filter comprising a porous material being arranged in an axial direction.

9. The device of claim 8 wherein one portion of said conduit in the proximity of said second opening is curvedly detoured around said bottom of said ink cartridge.

10. The device of claim 8 wherein said conduit has an inner diameter of 0.4 millimeter to 3.0 millimeter.

11. The device of claim 8 wherein said conduit comprises one selected from a stainless steel or a plastic material.

12. The device of claim 8 wherein said sleeve comprises a hollow portion including a gradually-shrinking portion and a tubular portion, in which said gradually-shrinking portion is telescoped with said conduit and said tubular portion is allowable to receive said filter.

13. The device of claim 8 wherein said sleeve comprises an elastic material.

14. The device of claim 8 wherein said porous material comprises a foam material.

15. The device of claim 8 wherein said porous material comprises a fibrous material.

16. The device of claim 8 wherein said porous material comprises a polymer comprising polypropylene and polyethylene.

17. The device of claim 8 wherein said filter has a density ranged from 0.01 g/cm$^3$ to 0.8 g/cm$^3$.

18. The device of claim 8 wherein said filter has a cross-sectional diameter of 2.0 millimeter to 9.0 millimeter.

19. A pressure regulating device for an ink cartridge which provides ink for use by an thermal bubble ink jet thin film chip, said ink cartridge comprises a housing, a cap and a filter, said ink jet thin film chip is mounted on a bottom of said housing and said cap is mounted on the opposite edge with respect to said ink jet thin film chip, said cap is provided with an opening portion communicable with an external fluid, said pressure regulating device comprising:

a conduit;

a sleeve; and a filter;

wherein said pressure regulating device is characterized by that said conduit comprises a hollow tubular member with a first opening being connected with said opening portion of said cap and a second opening being telescoped with said sleeve, said sleeve comprises a hollow portion including a gradually-shrinking portion and a tubular portion, in which said gradually-shrinking portion is telescoped with said conduit and said tubular portion is allowable to receive said filter, and said filter comprises tens of bundles of fibrous materials being arranged in an axial direction.

20. The device of claim 19 wherein said conduit has an inner diameter of 0.4 millimeter to 3.0 millimeter, and comprises one selected from a stainless steel or a plastic material.

21. The device of claim 19 wherein said filter comprises a foam material.

22. The device of claim 19 wherein said filter comprises a polymer comprising polypropylene and polyethylene.

23. The device of claim 19 wherein said filter has a density ranged from 0.01 g/cm$^3$ to 0.8 g/cm$^3$ and a cross-sectional diameter of 2.0 millimeter to 9.0 millimeter.

24. A pressure regulating device which maintains a constant atmospheric pressure of an ink cartridge, said ink cartridge comprises an opening portion connectable with an external fluid, comprising:

a conduit;

a sleeve; and a filter;

wherein said pressure regulating device is characterized by that said conduit is provided with a first opening connected with said opening portion and a second opening connected with said sleeve, and said sleeve is allowable to receive said filter comprising bundles of fibrous material.

* * * * *